United States Patent [19]

Harang et al.

[11] 3,958,522

[45] May 25, 1976

[54] AUTOMATIC CONTROL SYSTEM FOR HYDROFOIL CRAFT

[75] Inventors: Arlyn Orlando Harang, Seattle; John Hunt Scott, Issaquah; Irving Alfred Hirsch, Bellevue, all of Wash.

[73] Assignee: The Boeing Company, Seattle, Wash.

[22] Filed: Mar. 16, 1973

[21] Appl. No.: 342,024

[52] U.S. Cl. ..... 114/66.5 H; 244/175; 244/179; 244/181; 244/194; 318/588; 318/563; 318/585

[51] Int. Cl.[2] ..... B63B 1/28

[58] Field of Search ..... 114/66.5 H; 244/77 R, 244/77 D, 77 E, 77 M; 318/563–565, 585, 588

[56] References Cited

UNITED STATES PATENTS

| | | | |
|---|---|---|---|
| 2,673,314 | 3/1954 | MacCallum | 244/77 M |
| 2,859,005 | 11/1958 | Owen et al. | 244/77 M |
| 3,100,861 | 8/1963 | Osder | 244/77 M X |
| 3,137,260 | 6/1964 | Harris, Jr. et al. | 114/66.5 H |
| 3,156,209 | 11/1964 | Ask | 114/66.5 H |
| 3,403,874 | 10/1968 | Boskovich et al. | 244/77 M |
| 3,422,327 | 1/1969 | McBrayer et al. | 244/77 M X |
| 3,504,649 | 4/1970 | Scherer | 114/66.5 H |

*Primary Examiner*—Verlin R. Pendegrass
*Assistant Examiner*—Thomas H. Webb
*Attorney, Agent, or Firm*—Brown, Murray, Flick & Peckham

[57] ABSTRACT

A control system for hydrofoil craft is one in which control surfaces are moved automatically in response to signals derived from the motion of the craft to stabilize and control the craft. In such systems, a potentially dangerous condition can occur in case of a failure or malfunction in the roll control system. In order to prevent such conditions, two roll sensing devices are provided which normally generate identical signals to actuate the control surfaces to stabilize the rolling motion. In case a failure or malfunction, the signals provided by the two sensing devices become different and apparatus is provided to compare these signals and to respond to a difference in the signals to initiate landing of the craft rapidly and safely.

6 Claims, 3 Drawing Figures

AUTOMATIC CONTROL SYSTEM FOR HYDROFOIL CRAFT

ORIGIN OF THE INVENTION

The invention herein described was made under a contract with the United States Department of the Navy.

BACKGROUND OF THE INVENTION

In a hydrofoil seacraft, the hull of the craft is lifted out of the water by means of foils which are carried on struts and usually pass through the water beneath the surface thereof. In passing through the water, and assuming that sufficient speed is attained, the foils create enough lift to raise the hull above the surface and hence eliminate the normal resistance encountered by a ship hull in passing through the water.

In the usual case, there are forward and aft foils both provided with control flaps similar to those used on aircraft, although in some cases the entire foils may be rotatable and used as control surfaces. The other essential control element is the rudder which pierces or is submerged beneath the surface of the water and may be either forward or aft of the craft depending upon its design. In most hydrofoils, the flaps or control surfaces are used primarily to cause the craft to ascend or descend and to control the craft about its pitch and roll axes. However, they can also be used in combination with the rudder to bank the ship about its roll axis during a turn. The flaps are also used to stabilize the craft during movement on water, so that pitching or rolling motions can be minimized by proper counterbalancing movement of the flaps. A control system of this type is disclosed and claimed in a copending application of D. R. Stark et al, Ser. No. 302,599, filed Oct. 31, 1972, which matured into U.S. Pat. No. 3,886,884 on June 3, 1975 and is assigned to the Assignee of the present invention. The invention described herein is particularly useful in a system of this type although its usefulness is not necessarily restricted to this particular system.

In any hydrofoil control system, safety is a paramount consideration. In the type of control mentioned above, the roll control system comprises sensing means for sensing motion of the craft about the roll axis and means responsive to the signals generated by this sensing means to effect the desired movement of the control surfaces to counteract the rolling motion and stabilize the craft about the roll axis. In case of a failure or malfunction in this roll control system, an unsafe condition can develop in which the motion of the craft becomes unstable, and the craft can exhibit divergent motions such that it may impact the water with angular rates of motion and attitudes that can endanger personnel on board the craft and cause possible damage to the ship. It would be desirable, therefore, to detect the occurrence of such a failure promptly and to cause the ship to land, that is, to descend from the foil-borne mode to the hull-borne mode of operation, before these potentially dangerous conditions can result.

SUMMARY OF THE INVENTION

In accordance with the present invention, means are provided which will detect the occurrence of a malfunction or failure in the roll control system of a hydrofoil craft and will cause the craft to land quickly and safely before a dangerous condition can develop.

More specifically, two sensing devices are provided for sensing motion of the craft about the roll axis and generating signals to actuate the control surfaces as required. Under normal conditions, these signals from the two sensing devices are substantially identical and the operation is the same as in prior systems. If a failure or malfunction occurs, however, the output signals of the two sensing devices become different and this difference is utilized to detect the failure. For this purpose, means are provided for comparing the signals from the two sensing devices and if the signals differ by more than a predetermimed amount, a signal is produced to initiate landing action by rotating the forward flap or control surface to cause the craft to land rapidly and safely.

BRIEF DESCRIPTION OF THE DRAWINGS

The invention will be more fully understood from the following detailed description, taken in connection with the accompanying drawings, in which.

DESCRIPTION OF THE PREFERRED EMBODIMENT

Figure 1:
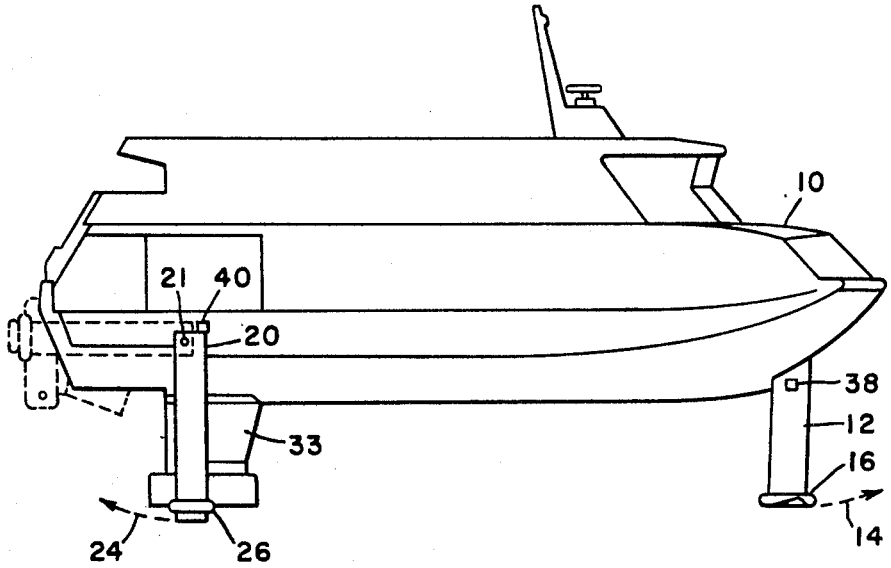
FIG. 1 is a side view of a typical hydrofoil craft with which the control system of the present invention can be used.

Referring now to the drawings, and particularly to FIG. 1, the hydrofoil shown includes a conventional hull 10 which can be provided with a propeller or the like and an inboard motor such that it can traverse the surface of water as a conventional displacement ship. Pivotally connected to the hull is a forward swiveled strut or rudder 12 which is rotatable about a vertical axis in order to steer the craft in the foil-borne mode of operation. The rudder 12 can also be swiveled upwardly in the direction of arrow 14 to clear the surface of the water when the craft is operating as a conventional displacement ship. Carried on the lower end of the rudder 12 is a forward foil 16 (FIG. 2) which carries at its trailing edge control surfaces or flaps 18 which are interconnected and operate in synchronism. Alternatively, the entire forward foil can be rotated for control. Thus, there is a single forward control surface which may be either a flap or the entire foil.

In the aft portion of the craft, struts 20 and 22 are pivotally connected to the hull 10 about an axis 21. The struts 20 and 22 can be rotated downwardly into the solid-line position shown in FIG. 1 for foil-borne operation, or can be rotated backwardly in the direction of arrow 24 and into the dotted-line position shown when the craft operates as a conventional displacement ship. Extending between the lower ends of the struts 20 and 22 is an aft foil 26 which carries at its trailing edge two starboard flaps 28 and 30 and two port flaps 32 and 34. Alternatively, the entire starboard and port foils can be rotated to serve as control surfaces. As will be seen, each set of starboard flaps and each set of port flaps normally operate in synchronism.

Carried between the struts 20 and 22 and pivotally connected to the hull 10 about axis 21 is a gas turbine-water jet propulsion system 33 which provides the forward thrust for the craft during foil-borne operation. It should be understood, however, that a propeller or other type of thrust-producing device can be used in accordance with the invention.

With the rudder 12 and struts 20 and 22 retracted, the craft may operate in the hull-borne mode. In the foil-borne mode of operation, both the rudder 12 and its foil 16, and struts 20 and 22 with foil 26, are rotated downwardly into the solid-line positions shown in FIG. 1 and locked in position. In order to become foil-borne, the pilot sets the desired foil depth in a manner hereinafter described and the throttles are advanced. The craft, therefore, will accelerate and the hull will clear the water and continue to rise until it stabilizes at the commanded foil depth. The normal landing procedure is to simply reduce the throttle setting, allowing the ship to settle to the hull as the speed decays.

Figure 2:
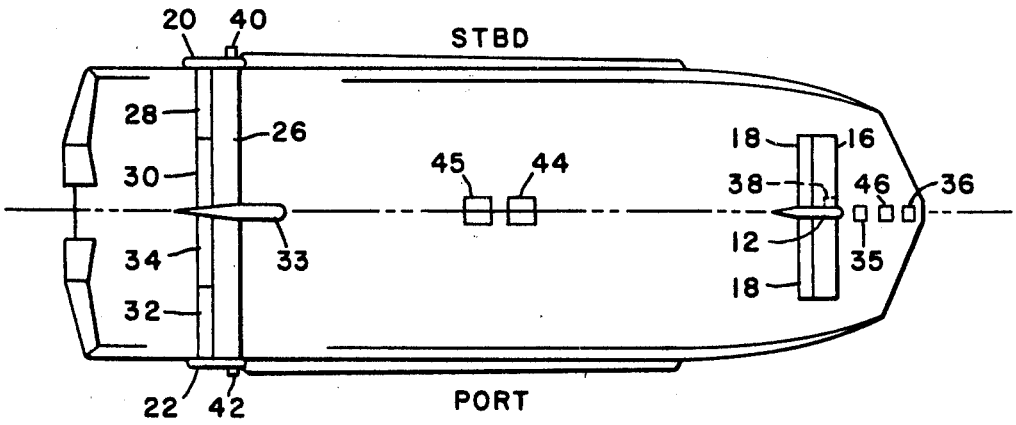
FIG. 2 is a bottom view of the craft shown in FIG. 1.

Mounted on the hull, as shown in FIG. 2, are sensors for producing electrical signals indicative of craft motion. Thus, at the bow of the craft is a height sensor 36 which produces an electrical signal proportional to the height of the bow above the surface of the water during foil-borne operation. Also at the bow of the ship is a forward vertical accelerometer 35 which produces an electrical signal proportional to vertical acceleration. Mounted on the rudder 12 is a lateral accelerometer 38 which produces an electrical signal proportional to lateral or sideways acceleration of the craft. Mounted on the top of the starboard strut 20 is an aft starboard vertical accelerometer 40, and mounted at the top of the port strut 22 is an aft port vertical accelerometer 42. Means are also provided for sensing motion of the craft about its pitch and roll axes; and in accordance with the present invention, two such sensors are provided. For this purpose, two vertical gyros 44 and 45 are mounted in the craft and produce signals proportional to the angle of the craft with respect to vertical about its pitch and roll axes. The devices 44 and 45 are preferably identical and normally produce substantially identical signals. Finally, a yaw rate gyro 46 is provided. The accelerometers and the gyros as described will thus sense motions of the craft about its roll, pitch and yaw axes.

Any movement about the roll axis will be sensed by the vertical gyros 44 and 45 as well as the aft accelerometers 40 and 42. The gyros 44 and 45 will produce identical output signals proportional to the amount or degree of roll, while the accelerometers 40 and 42 will produce signals proportional to the second rate of change in position about the roll axis. Any movement about the pitch axis will be sensed by the vertical gyros 44 and 45 as well as both the forward and aft accelerometers 35, 40 and 42. Finally, any movement about the yaw axis will be sensed by the yaw rate gyro 46 as well as by the lateral accelerometer 38.

In the normal control of the hydrofoil shown herein, the change of height of the hull above the water is controlled solely by the forward flap 18. In order to raise or lower the hull while foil-borne, the forward flap is rotated downward, thereby increasing the lift afforded by the forward foil 16 and causing the hull to elevate out of the water. In order to eliminate or minimize pitching motions about the pitch axis, both the forward and aft control surfaces are employed. However, the forward and aft surfaces operate in opposite directions to correct any pitch condition. Compensation for movement about the roll axis is achieved solely by the aft surfaces 28, 30, 32 and 34. However, in this case, the starboard flaps move in a direction opposite to the port flaps to correct for any undesired rolling motion. In turning the craft, the aft flaps are initially positioned to cause the craft to bank about its roll axis, and the rudder 12 is then rotated to follow through. This gives a much better and smoother turning action since the correct roll inclination is achieved before any substantial turning of the craft occurs by means of the rudder.

The particular hydrofoil control system described herein forms the subject matter of the above-mentioned copending application. The present invention, however, can be used with any hydrofoil control system which includes a roll control having sensing means for sensing motion about the roll axis and control surfaces actuated in response to signals produced by such sensing means.

Figure 3:
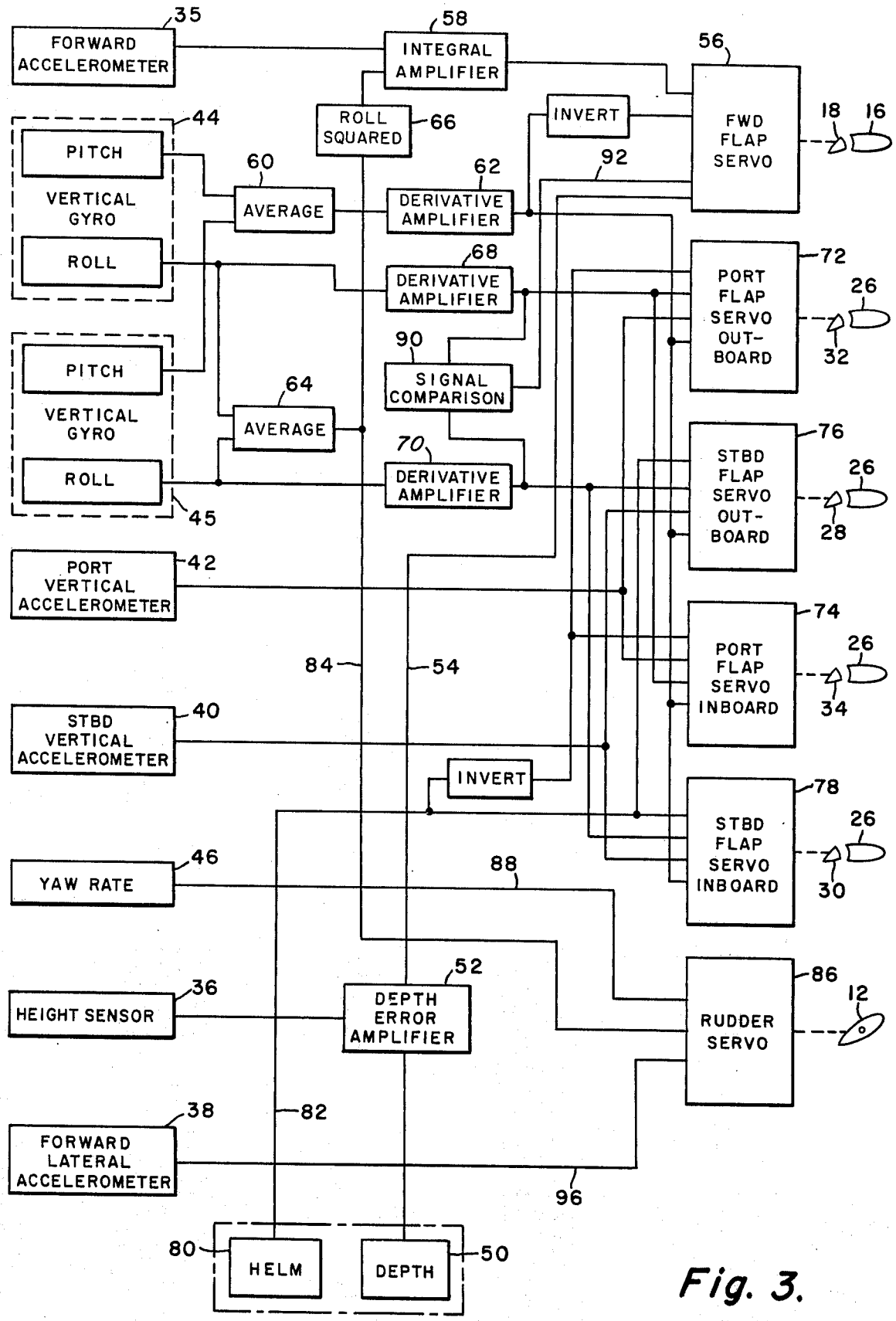
FIG. 3 is a block schematic diagram showing the control system of the present invention.

The control system is shown in the form of a block diagram in FIG. 3. As there shown, the signal from the height sensor 36 proportional to actual height of the craft above the water surface is compared with a height signal from the pilothouse depth control 50 in a depth error amplifier 52. If the two signals fed to the amplifier 52 are not the same, then an error signal is developed on lead 54 and applied to a forward flap servo system 56 which causes the forward flap 18 to rotate downward or upward, depending upon whether the hull should rise or descend.

The forward accelerometer 35 senses acceleration, either upward or downward, at the bow and produces an electrical signal for controlling the forward flap 18 to counteract movement about the pitch axis of the craft. The output of the forward accelerometer 35, however, is combined in an integral amplifier 58 with a signal proportional to the square of the roll motion signal, derived as described hereinafter, before the combined signal is applied to the forward flap servo 56. This is for the reason that during normal rolling action, or while the craft is being banked during a turn, the rolling movement produces a component of vertical acceleration which must be taken into consideration.

A signal proportional to the angle of the craft about the pitch axis is derived from the vertical gyros 44 and 45. These two gyros are substantially identical, and the pitch signals produced by the two gyros are combined in an averaging circuit 60 and applied to a derivative amplifier 62 which produces an output signal which varies as a function of pitch angle from the horizontal and rate of change of the pitch angle. The output of the pitch derivative amplifier 62 is applied to all of the aft flap servos and is also applied in inverted form to the forward flap servo 56 to achieve differential control. This signal is used for stability augmentation, ride smoothing in a seaway, and automatic pitch trim control.

If the craft is rolling about its roll axis, signals are derived from the vertical gyros 44 and 45. The signals from these gyros are normally identical and are proportional to the angle of the craft from the vertical about the roll axis. The two signals are combined in an averaging circuit 64 to provide a signal which is applied to the roll squaring circuit 66 for combination with the forward accelerometer signal as described above. In addition, the signal from the vertical gyro 44 is applied to a derivative amplifier 68 and the signal from the gyro 45 is applied to a derivative amplifier 70. The signals applied to these amplifiers will, of course, increase in one direction or polarity and then decrease to zero and increase in the other polarity as the craft rolls from side-to-side. This produces at the outputs of the derivative amplifiers 68 and 70, signals which vary as a function of both the roll angle and the rate of change of roll angle. The signal from derivative amplifier 68 is applied to the aft port flap servos 72 and 74 while the signal from the derivative amplifier 70 is applied to the aft starboard flap servos 76 and 78. The arrangement is such that a signal of one polarity is thus applied to the port flap servos, while a signal of inverted polarity is applied to the starboard flap servos, to achieve rotation of the port and starboard flaps in opposite directions to counteract the rolling motion and stabilize the craft about the roll axis.

The output of the port vertical accelerometer 42 is applied to the port flap servos 72 and 74, and the output of the starboard vertical accelerometer 40 is applied to the starboard flap servos 76 and 78. These signals act to vary the flap positions to counteract any vertical accelerations or heave on their respective sides of the craft.

Movement of the craft about its yaw axis, or turning movement, is controlled by the roll control system and by signals from the helm 80. If it is desired to turn while the craft is traveling through smooth water, for example, a signal is applied to the lead 82 from the helm 80 of a magnitude and polarity determined by the desired direction and extent of the turn. This signal is applied to the starboard servos 76 and 78 and in inverted form to the port servos 72 and 74. The result is that one set of aft flaps rotates downwardly while the other set rotates upwardly to cause the craft to bank about its roll axis. This action will continue until the angle of roll as sensed by the gyros 44 and 45 is such as to generate signals to balance out the helm signal. At the same time, the roll angle signal derived from the averging circuit 64 is applied through a lead 84 to the rudder servo 86. This causes the rudder 12 to rotate after the craft begins to bank about the roll axis, causing the craft to turn in the direction in which it has been banked. Thus, if the craft banks to the right in response to a signal from helm 80, the rudder 12 will rotate to steer the craft to the right. This gives a very smooth turn for all sea conditions encountered with a minimum of acceleration forces on the passengers and crew.

As the ship turns, the yaw rate gyro 46 will produce a signal on lead 88 proportional to the rate of turning about the yaw axis and this is utilized in the rudder servo 86 to limit the rate of turning. Similarly, the signal from the lateral accelerometer 38 is also applied to the rudder servo 86 to limit the lateral acceleration. After the desired turn has been executed, the helm 80 is returned to its center or null position and the signal on lead 82 drops to zero. The positions of the aft flaps are thus reversed under the control of the vertical gyros 44 and 45 to bring the craft back to its upright position with the rudder 12 again centered.

In a control system of this type, a failure or malfunction in the roll cntrol can result in a hazardous condition. Such a failure can cause loss of control of the control surfaces, resulting in uncontrolled movements or in failure of the control surfaces to move as required. This can cause the ship to exhibit divergent motions such that it may impact the water with angular rates or attitudes large enough to be hazardous to personnel on board the ship and to cause possible damage to the ship itself. This is a particularly dangerous possibility in prior control systems in which a single roll angle sensing means is used, or in which the control surfaces are commonly controlled by such a sensing means.

As described above, in accordance with the present invention, this hazardous condition is prevented by sensing the occurrence of a malfunction or failure in the roll control very promptly, and taking immediate corrective action by causing the ship to descend from the foil-borne mode to the hull-borne mode of operation where it can be safely operated. For this purpose, as previously described, two identical roll sensing means are provided such as the vertical gyros 44 and 45. Under normal conditions, the signals from these gyros are combined in the averaging circuit 64 and are also applied separately through the derivative amplifiers 68 and 70 to control the port and starboard aft control surfaces, respectively. This operation of the system under normal conditions is similar to that of the system disclosed in the copending application mentioned above.

In order to detect the occurrence of a failure or malfunction, however, the signals obtained from the derivative amplifiers 68 and 70 are applied to a signal comparison circuit 90 where they are compared with each other. Under normal conditions, the signals from the two gyros 44 and 45 will be substantially identical, and the difference between them will be essentially zero so that no output signal appears from the circuit 90. If a malfunction of either of the two gyros should occur, however, or if there should be a failure in the circuitry such as a short circuit or open circuit in one of the amplifiers or circuits, the signals derived from the two gyros, that is, the output signals of the amplifiers 68 and 70, will no longer be identical. An output signal, therefore, appears from the signal comparison circuit 90 and this signal is applied through the lead 92 to the forward flap servo 56. The signal thus applied to the forward flap servo rotates the flap upward to cause the craft to descend and to land on the water rapidly and safely, so that the mode of operation changes from foil-borne to hull-borne before a dangerous condition can develop. Since other signals may be applied simultaneously to the servo 56 from the other sensing systems described, the signal comparison circuit 90 is made to develop a signal of sufficient magnitude to override or swamp any other signals that may be simultaneously applied to the servo, so that the craft is quickly and reliably caused to land.

Because of component tolerances in the electronic circuitry and the gyros themselves, and because of small changes in characteristics with time, the two output signals of the amplifiers 68 and 70 may not be exactly identical during normal operation and this difference should be provided for. Thus, the circuit 90 should preferably be designed so that it provides an output signal only when the signals from the amplifiers 68 and 70 differ by more than some predetermined amount, such as that corresponding to 10° difference in the roll signals, for example. It is also possible that large but very short duration transient conditions may occur in either roll system. Such transients have no serious effect and it is undesirable for the automatic landing circuit to be excited by such transients. For this reason, the comparison circuit 90 should also provide that the difference between the two signals must exist for some predetermined time, such as 100 milliseconds, for example, before an output signal appears on the lead 92.

It should now be apparent that a hydrofoil control system has been provided in which failure or malfunction in the roll control is detected promptly and immediate action is taken to cause landing of the craft on the water before a dangerous condition can develop. It will also be apparent that the invention may be applied to other types of control systems as well as the specific system disclosed for the purpose of illustration, and that various changes and other embodiments are possible and may be made within the scope of the invention.

We claim as our invention:

1. In a control system for a hydrofoil craft having a forward control surface and separate port and starboard aft control surfaces, means for generating signals for controlling the positions of said control surfaces, said signal generating means including first and second sensing means for sensing motion of the craft about its roll axis and providing output signals in response thereto, means responsive to said output signals for actuating said aft control surfaces, means for comparing the output signals of said first and second sensing means, and means responsive to a predetermined difference between said signals for actuating said forward control surface to cause the craft to descend from the foil-borne mode to the hull-borne mode of operation.

2. The control system of claim 1 including means responsive to the output signals of the first sensing means for actuating said port aft control surfaces, and means responsive to the output signals of the second sensing means for actuating said starboard aft control surfaces.

3. The control system of claim 1 including means for comparing the output signals of said first and second sensing means, and means for actuating said forward control surface when the difference between said signals exceeds a predetermined amount for a predetermined time.

4. The control system of claim 3 including servo means for actuating said forward control surface, and means responsive to the difference of the output signals of said first and second sensing means for providing a signal to said servo means of sufficient magnitude to override any other signal that may be applied to the servo means.

5. The control system of claim 1 in which said first and second sensing means are vertical gyros adapted to normally generate substantially identical output signals in response to motion of the craft about its roll axis.

6. The control system of claim 5 including means for comparing said output signals, and means for actuating said forward control surface when the difference between the signals exceeds a predetermined amount for a predetermined time.

* * * * *